US007562862B1

(12) United States Patent
Jackson

(10) Patent No.: US 7,562,862 B1
(45) Date of Patent: Jul. 21, 2009

(54) TENSIONING ASSEMBLY

(75) Inventor: Stephen D. Jackson, Stockton, CA (US)

(73) Assignee: USA Products Group, Inc., Lodi, CA (US)

( * ) Notice: Subject to any disclaimer, the term of this patent is extended or adjusted under 35 U.S.C. 154(b) by 0 days.

(21) Appl. No.: 11/929,322

(22) Filed: Oct. 30, 2007

(51) Int. Cl.
*B66D 5/32* (2006.01)

(52) U.S. Cl. ..... 254/376; 254/333; 254/383; 254/391; 254/403; 254/411

(58) Field of Classification Search ..... 254/376, 254/223, 333, 371, 374, 383, 391, 403, 411
See application file for complete search history.

(56) References Cited

U.S. PATENT DOCUMENTS

| | | | | | |
|---|---|---|---|---|---|
| 958,182 | A | * | 5/1910 | Schnoor | 254/398 |
| 3,765,652 | A | * | 10/1973 | Janik | 254/376 |
| 3,776,517 | A | * | 12/1973 | Davis et al. | 254/332 |
| 3,939,729 | A | * | 2/1976 | Brockelsby | 74/575 |
| 4,225,118 | A | * | 9/1980 | Ottemann | 254/333 |
| 4,475,854 | A | * | 10/1984 | Ericsson | 410/103 |
| 5,368,279 | A | * | 11/1994 | Ottemann et al. | 254/324 |
| 5,368,281 | A | | 11/1994 | Skyba | |
| D362,614 | S | | 9/1995 | Kingery | |
| 5,681,094 | A | * | 10/1997 | Brown et al. | 297/484 |
| 5,722,640 | A | | 3/1998 | Skyba | |
| 6,068,242 | A | | 5/2000 | Kingery | |
| 6,092,791 | A | | 7/2000 | Kingery | |
| 6,149,133 | A | | 11/2000 | Skyba | |
| 6,558,092 | B1 | * | 5/2003 | Woodruff | 410/12 |
| 6,960,053 | B2 | * | 11/2005 | Woodruff | 410/12 |
| 7,062,992 | B2 | * | 6/2006 | Spirer | 81/57.3 |
| 2006/0133905 | A1 | * | 6/2006 | Woodruff | 410/23 |

* cited by examiner

*Primary Examiner*—Emmanuel M Marcelo
(74) *Attorney, Agent, or Firm*—Haynes and Boone, LLP

(57) ABSTRACT

A tensioning assembly comprising a housing having a first sidewall and a second sidewall, and a ratchet mechanism disposed between the first sidewall and the second sidewall. The ratchet mechanism includes a tension release assembly biased in a first direction for lateral engagement with the ratchet mechanism, and lateral disengagement of the ratchet mechanism when pressure is applied to the tension release assembly in a second direction opposite to the first direction, is described herein. The assembly may include a force generating mechanism configured to provide a mechanical advantage when tensioning the device, and a guide roller for promoting line contact with a rotatable gripping wheel assembly.

17 Claims, 6 Drawing Sheets

TENSIONING ASSEMBLY

BACKGROUND

Various pulley mechanisms used with cords typically include a ratchet mechanism having a rotatable spool, wheel, or sheave with a plurality of outwardly-extending teeth for engagement with a spring-loaded pawl. As the spool is rotated in a one direction, a cord, rope, or cable is wrapped around the spool so as to apply tension to the cord, rope, or cable. As the spool rotates, the pawl incrementally engages the teeth to prevent the spool from rotating in the opposite direction due to the tension from the cord, rope, or cable.

Although pulley mechanisms are well known, it would be desirable to provide an improved pulley mechanism for applying a tension to a line in an efficient and consistent manner.

SUMMARY

For purposes of summarizing the disclosure, exemplary embodiments having certain objects and advantages have been described herein. It is to be understood that not necessarily all such objects and advantages may be achieved in accordance with any particular embodiment. Thus, for example, those skilled in the art will recognize that embodiments may be carried out in a manner that achieves or optimizes one advantage or group of advantages as taught herein without necessarily achieving other objects or advantages as may be taught or suggested herein.

In one embodiment, a ratchet mechanism comprises a rotatable wheel, and a pawl positioned and configured to engage the wheel to permit rotation of the wheel in a single direction and to laterally disengage from the wheel when lateral pressure is applied to the pawl.

In another embodiment, a tensioning assembly comprises a housing having a first sidewall and a second sidewall, and a ratchet mechanism disposed between the first sidewall and the second sidewall. The ratchet mechanism includes a tension release assembly biased in a first direction for lateral engagement with the ratchet mechanism, and lateral disengagement of the ratchet mechanism when pressure is applied to the tension release assembly in a second direction opposite to the first direction.

In still another embodiment, a method for disengaging a pawl from a rotatable wheel in a ratchet mechanism includes the step of applying pressure to the pawl to laterally disengage the pawl from the wheel.

These and other embodiments will become readily apparent to those skilled in the art from the following detailed description of the various embodiments having reference to the attached figures, the invention not being limited to any particular preferred embodiment(s) disclosed.

DETAILED DESCRIPTION

Exemplary embodiments will now be described with references to the accompanying figures, wherein like reference numbers refer to like elements throughout. The terminology used in the description presented herein is not intended to be interpreted in any limited or restrictive manner simply because it is being utilized in conjunction with a detailed description of certain embodiments. Furthermore, various embodiments (whether or not specifically described herein) may include novel features, no single one of which is solely responsible for its desirable attributes or which is essential to practicing any of the embodiments herein described.

The present disclosure relates generally to a pulley mechanism, and more particularly to a tensioning assembly having, among other things, a force generating mechanism, a tension release assembly for lateral disengagement of a ratchet mechanism, and a guide roller for urging a line into contact with the ratchet mechanism for ease in moving an object.

Figure 1:
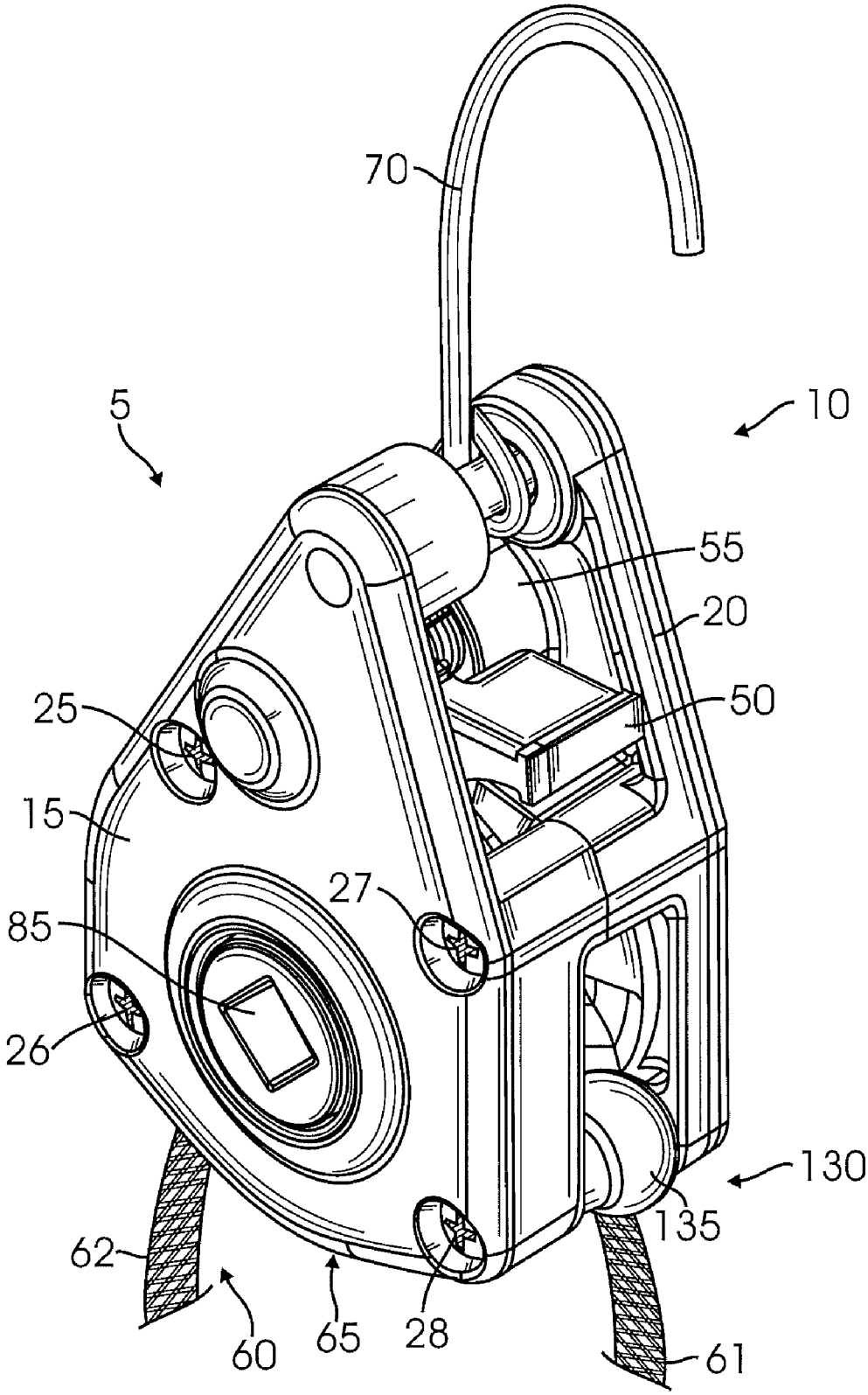
FIG. 1 is a perspective view generally showing a tensioning assembly in accordance with one embodiment.
Figure 2:
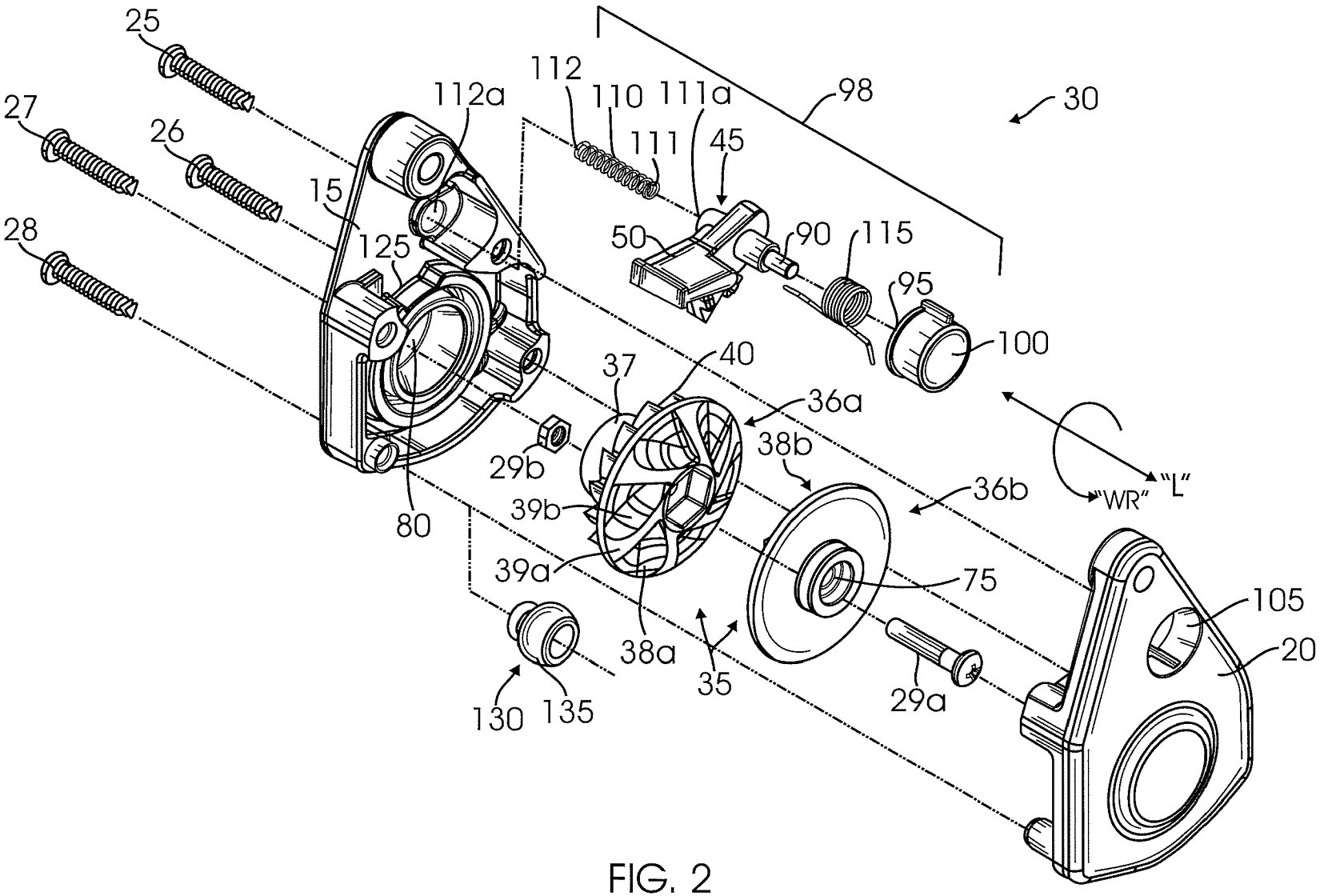
FIG. 2 is an exploded perspective view showing the tensioning assembly of FIG. 1 in accordance with one embodiment.

FIG. 1 is a perspective view generally showing a tensioning assembly, and FIG. 2 is an exploded perspective view showing the tensioning assembly of FIG. 1, each in accordance with an embodiment. The tensioning assembly 5 includes a housing 10, constructed from molded plastic or other suitable material for providing a rigid and sturdy frame for the components contained within the housing 10. The housing 10 has a first sidewall 15 for removable attachment to a second sidewall 20 by connectors 25-28 such as fasteners, screws, or the like received within corresponding orifices formed in each of the first sidewall 15 and second sidewall 20. A ratchet mechanism 30 (see FIG. 2), disposed within the housing 10, includes a gripping wheel assembly 35 rotatable about an axis of rotation, having a plurality of outwardly-extending teeth 40 and a spring-loaded pivotally mounted pawl 45 for engaging the teeth 40. The pawl 45 may include an engaging/disengaging arm 50 accessible to a user operating the tensioning assembly 5 through a window 55 formed in an upper portion of the housing 10 between the first sidewall 15 and the second sidewall 20. The engaging/disengaging arm 50 provides for rotatable engagement and disengagement of the pawl 45 about the axis of wheel rotation.

The tensioning assembly 5 may be used to apply a tension to a line. The line comprises a slender length of flexible material, such as a rope, cord, strap, cable, chain, or the like. Preferably, a line 60 having a first line end 61 and a second line end 62 is provided and wrapped partially about the wheel assembly 35 with the line ends 61, 62 extending from an opening 65 in one end, i.e., the line opening end of the tensioning assembly 5. The tensioning assembly 5 can be used to apply a tension to the second line end 62 (which could be, e.g., attached to an object to be moved) by pulling on the first line end 61. A hook 70 or other suitable mechanism for coupling the tensioning assembly 5 to another structure is preferably provided at an end of the tensioning assembly 5 generally opposite to the line opening end for securing the tensioning assembly 5 when the tensioning assembly 5 is in use.

As described in more detail below, the tensioning assembly 5 includes ratchet mechanism 30 configured to provide a mechanical advantage when tensioning the tensioning assembly 5, a tension release assembly for lateral disengagement of the pawl 45 from the gripping wheel assembly 35, and a guide roller for promoting line 60 contact with the rotatable gripping wheel assembly 35.

As shown in FIG. 2, the rotatable gripping wheel assembly 35 may include a first portion 36*a* having a plurality of outwardly extending teeth 40 concentrically positioned on a cylindrical boss 37, and an inward gripping surface 38*a* for mating with a similarly formed inward gripping surface 38*b* on a second portion 36*b*. In one embodiment, the gripping surfaces 38*a*, 38*b* include alternating ridges 39*a* and valleys 39*b*. Preferably, the ridges 39*a* extend radially outward on the gripping surfaces 38*a*, 38*b* in a curved pattern. The top of each ridge 39*a* includes an outermost flared portion near the periphery of each gripping surface 38*a*, 38*b*, a gradually tapered middle portion, and a reduced inner portion. Each ridge 39*a* preferably includes angled sides having a greater degree of incline or slope along the outermost flared portion of the ridge 39*a* with the degree of incline gradually decreasing along the length of the ridge 39*a* to the inner portion.

Each of the valleys 39*b* are shaped to mate with a corresponding ridge 39*a*. That is, the valleys extend radially outward on the gripping surfaces 38*a*, 39*b* in a curved pattern matching that of the ridges 39*a*. Each valley 39*b* includes an outermost flared portion, a gradually tapered middle portion, and a reduced inner portion. As the valleys 39*b* and ridges 39*a* are positioned in an alternating fashion, the valleys 39*b* share the inclined sides of the ridges 39*a*.

A connecting device 29*a*, such as a threaded screw or bolt may be used to connect the first and second portions 36*a*, 36*b* together. The connecting device 29*a* pass through a cavity or orifice 75 formed generally in the center of the first portion 36*a* including the cylindrical boss 37 and the second portion 36*b*. A suitably threaded nut 29*b* may be coupled to the threaded screw or bolt to secure the connecting device 29*a* to the rotatable gripping assembly 35, thereby coupling the first and second portions 36*a*, 36*b* together. The line 60 is compressibly received between the coupled first and second portions 36*a*, 36*b*, such that rotation of the gripping wheel assembly 85 causes the line 60 to travel with the ridges 39*a*. Accordingly, rotational movement of the gripping wheel assembly 85 is translated in to linear movement of the line 60.

The cylindrical boss 37 is received and retained in an appropriately sized opening 80 in the first sidewall 15 of the housing 10 so that a cavity 85 formed in the cylindrical boss 37 is made accessible on an exterior side of the first sidewall 15 while the teeth 40 and gripping surfaces 38*a*, 38*b* of the rotatable gripping wheel assembly 35 are positioned on the opposite side of the first sidewall 15. The second sidewall 20 is joined with the first sidewall 15 to enclose the rotatable gripping wheel assembly 35 between the first and second sidewalls 15, 20.

In this regard, the cavity 85 formed in the cylindrical boss 37 is configured and shaped to removably accept an external tensioning device (not shown), such as a conventional ratchet wrench commonly found in many personal tool boxes. In the illustrated embodiment, the cavity 85 is adapted to receive the square ¼" drive lug from a conventional ratchet wrench, although in other embodiments, the shape and size of the cavity 85 may vary to accommodate different types of tensioning devices. In some embodiments, the cavity 85 may also include a detent for receiving a spring-loaded ball provided on a lateral side of the conventional drive lugs. Upon insertion of the drive lug into the cavity 85, the ratchet wrench may be used to apply a rotational force to cavity 85 to rotate the rotatable gripping wheel assembly 35. The rotation of the gripping wheel assembly 35 will cause the line 60 in contact with the gripping wheel assembly 35 to travel with the gripping surfaces 38*a*, 38*b* in the direction of rotation, thereby applying a pulling force to the line 60. In contrast to the hand-over-hand method that would typically be used to tension an object attached to the line 60, the ratchet mechanism 30 described herein includes a cavity 85 formed in the rotatable gripping wheel assembly 35 and configured to receive a tensioning device. This tensioning device can be used to apply a greater torque to the gripping wheel assembly 35, thereby increasing the force that can be applied to the line 60.

A spring-loaded pivotally mounted pawl 45 is disposed within the housing 10 of the tensioning assembly 5 and is positioned and configured to engage the outwardly extending teeth 40 of the first portion 36*a* of the rotatable gripping wheel assembly 35. The pawl 45 is pivotally-mounted within the housing 10 by a pivot pin 90 extending outward from a first side 46 of the pawl 45. The pivot pin 90 is received into a cap 100 having a cavity 95 configured to receive the pivot pin 90. The cap 100 is positioned and biased, as described below, to permit lateral movement of the cap 100 within a cylindrical opening 105 formed in the second sidewall 20.

The pawl 45 is pivotally-mounted on a second side 47 opposite the first side 46 and biased toward the second sidewall 20 of the housing 10 by a first tension spring 110 having a first end 111 and a second end 112. The first end 111 of the spring 110 being received into a corresponding cavity 111*a* formed in the second side 47 of the pawl 45, and the second end 112 of the first tension spring 110 being operably connected and received into a corresponding cavity 112*a* formed in the first sidewall 15 of the housing 10.

A second tension spring 115 is operably connected about the pivot pin 90. The second tension spring 115 is configured to bias the pawl 45 for engagement with the outwardly extending teeth 40 of the gripping wheel assembly 35. Accordingly, the first tension spring 110 biases the pawl 45 laterally within the housing 10 in a direction generally parallel to the axis of wheel rotation while the second tension spring 115 rotatably biases the pawl 45 in a direction generally perpendicular to the lateral movement of the pawl 45 within the housing 10, i.e., about the axis of wheel rotation.

Figure 3:
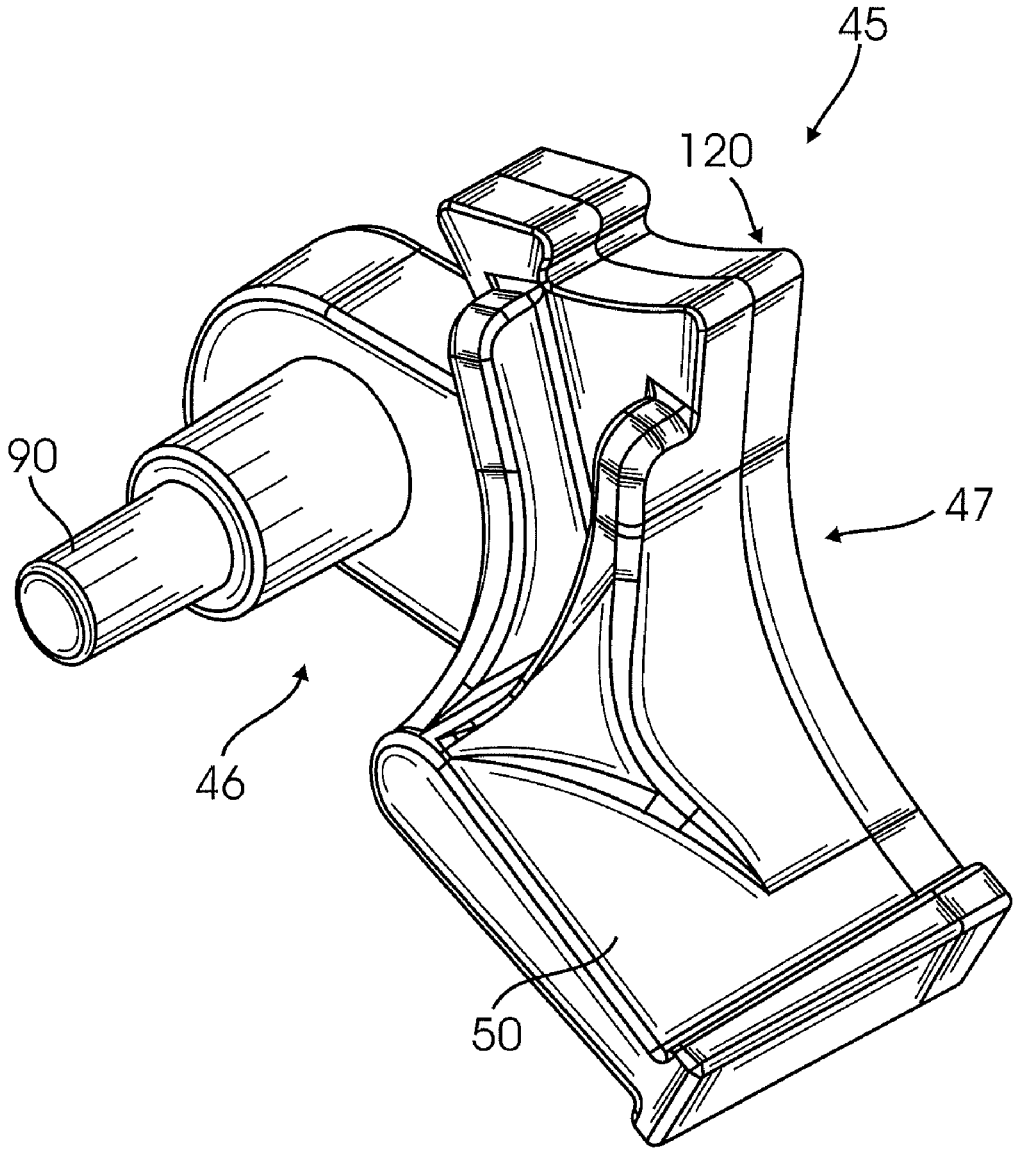
FIG. 3 is an enlarged perspective view of the pawl of FIG. 2 in accordance with one embodiment.

In this regard, as the gripping wheel assembly 35 is rotated in a first direction, as shown by reference "WR", the second tension spring 115 biases the pawl 45 in the same direction, to cause an engaging pawl tooth 120 formed on the pawl 45 (FIG. 3) to incrementally engage the outwardly extending teeth 40 of the gripping wheel assembly 35 to prevent the gripping wheel assembly 35 from rotating in the opposite direction such that the line 60 in contact with the gripping surfaces 338*a*, 38*b* of the gripping wheel assembly 35 moves about the wheel assembly 35 in the direction of wheel rotation "WR" to tension or retrain an object attached to the line 60.

Figure 6:
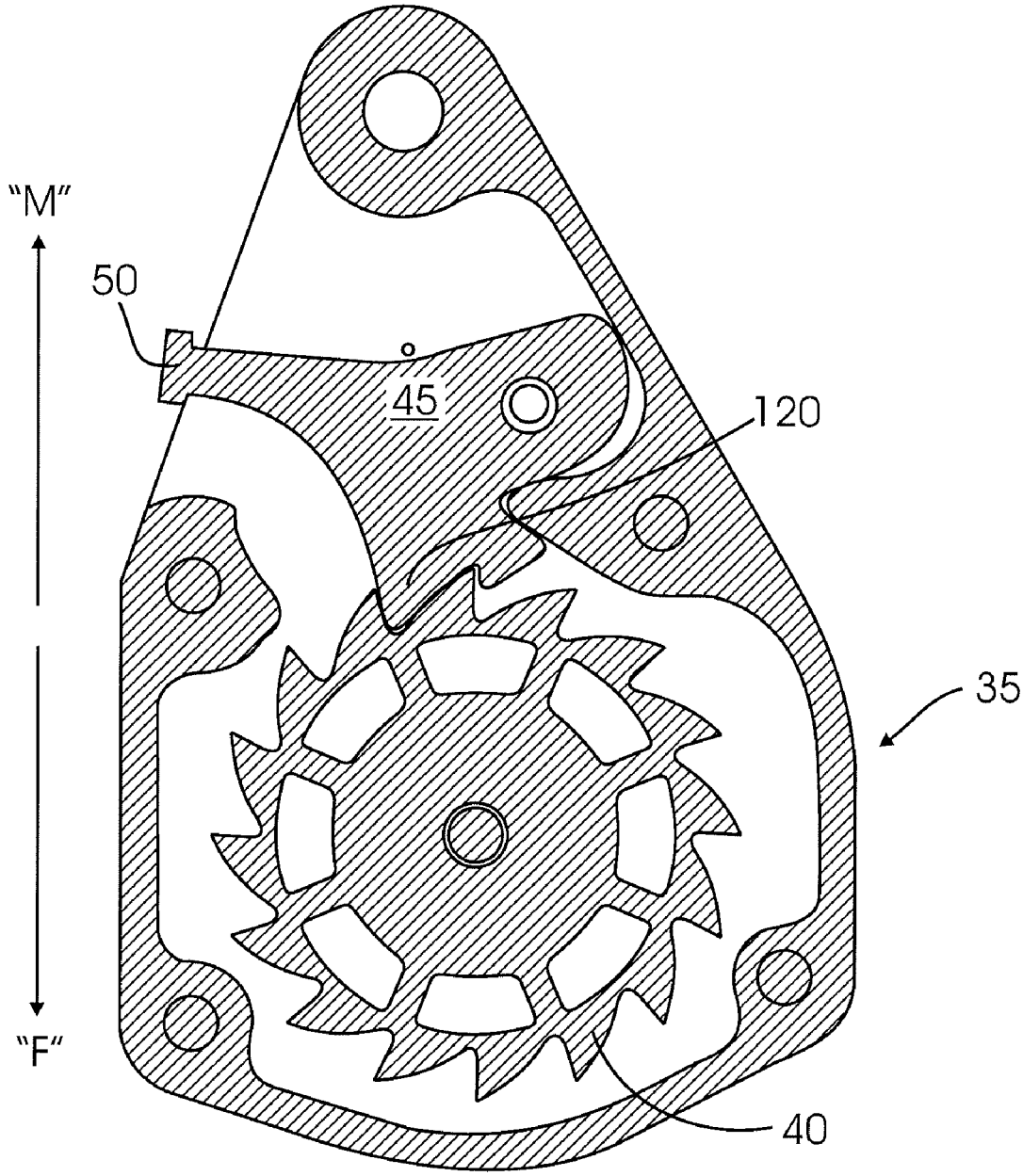
FIG. 6 is a cross-sectional side view of the tensioning assembly of FIG. 1 in accordance with one embodiment.

Disengagement of the ratchet mechanism 30 may be accomplished in a conventional manner by lifting the engaging/disengaging arm or flange 50 formed on the pawl 45 and made accessible in the window or opening 55 between the first sidewall 15 and second sidewall 20 of the housing 10 to remove the engaging pawl tooth 120 from engagement with the outwardly extending teeth 40. However, if an extremely heavy load is applied to the line 60, the line 60 may bias the gripping wheel assembly 35 in the direction WR. This may cause the tooth 40 which is engaging the engaging pawl tooth 120 to apply an extremely large force on the pawl tooth 120. This may make it difficult to manually push the flange 50 to disengage the ratchet mechanism 30. Accordingly, as shown in FIG. 6, this method usually requires that additional forward tension (indicated by reference "F") be applied to the line 60 to rotate the gripping wheel assembly 35 before the flange 50 can be moved (indicated by reference "M") away from the teeth 40 to disengage the ratchet mechanism 30. As such, a person must use both hands (one hand to apply additional tension and one hand to lift up on the flange) to disengage the ratchet mechanism 30.

Figure 4:
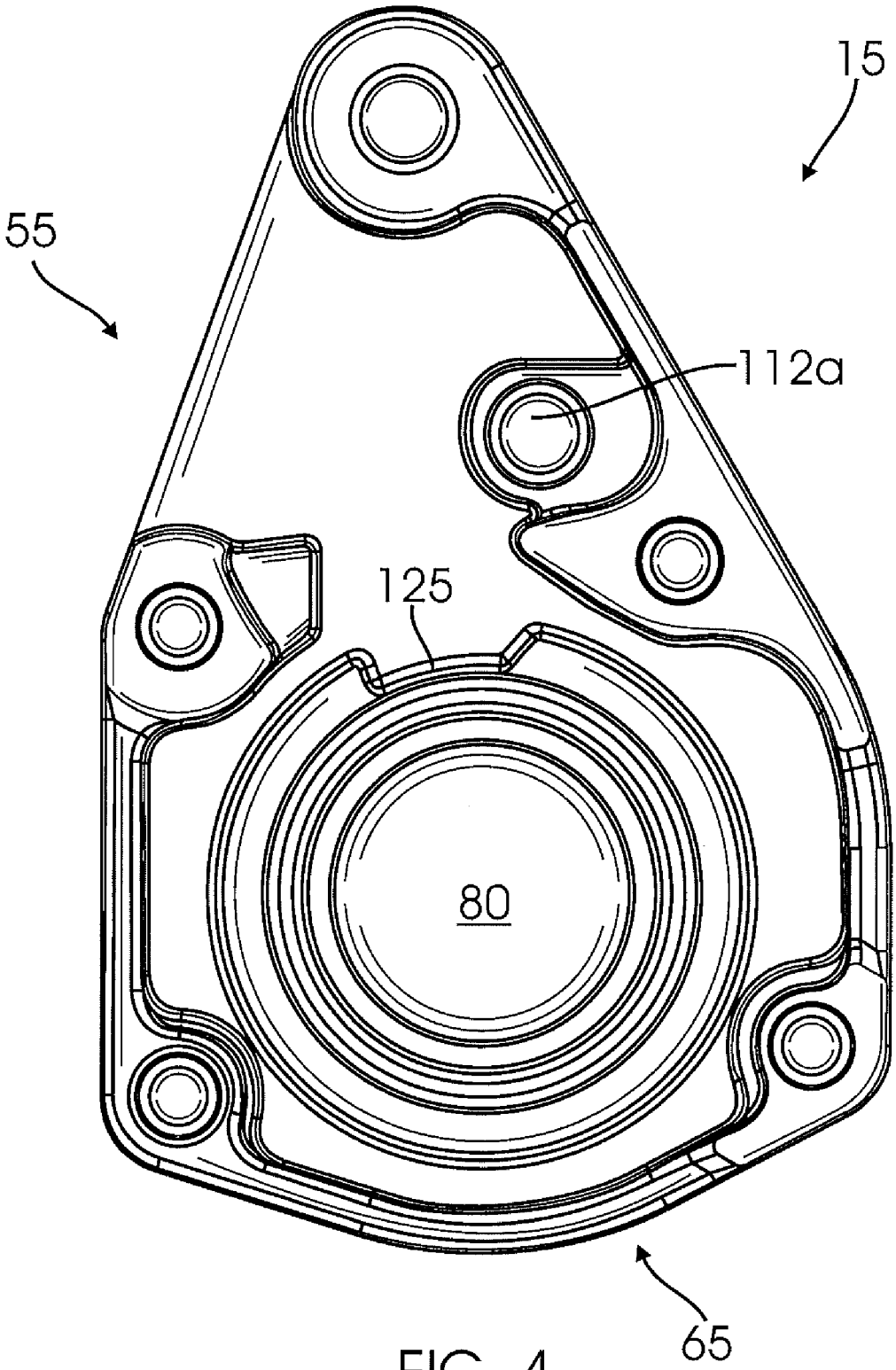
FIG. 4 is cross-sectional side view of the first sidewall of the tensioning assembly housing of FIG. 2 in accordance with one embodiment.

The tensioning assembly 5 according to one embodiment solves this problem by providing a tension release assembly 98 for lateral or slidable disengagement of the pawl 45 from the gripping wheel assembly 35. In this regard, when pressure is applied using, for example, a finger or similar object to the cap 100 (pushbutton) positioned within the cylindrical opening 105 in the second sidewall 20 of the housing 10, the cap 100 is translated laterally, as shown by reference "L", toward the first sidewall 15 of the housing 10. The pawl 45, in contact with the cap 100 by way of the pivot pin 90, is likewise translated laterally toward the first sidewall 15 of the housing 10. This causes the engaging pawl tooth 120 to be translated laterally so as to disengage from the outwardly extending teeth 40 of the wheel assembly 35. The pawl 45 may be received on a ledge 125 (see FIG. 4, a side view of the first sidewall in accordance with one embodiment) formed on the first sidewall 15 of the housing 10 to disengage to ratchet mechanism 30. The ledge 125 maintains the pawl 45 in proper position and alignment so that when pressure is removed from the cap 100, the first tension spring 110 biases or forces the tension release assembly 98 back towards the second side 20 of the housing 15 to again laterally engage the outwardly extending teeth 40 of the gripping wheel 35 assembly.

Accordingly, the tension release assembly 98 negates the need to apply additional tensioning force to release the pawl 45 from engagement with the outward extending teeth 40 of the ratchet mechanism 30. Furthermore, the lateral movement of the tension release assembly 98, as indicated by reference "L" and generally parallel to the axis of rotation of the rotatable gripping wheel assembly 35, may be accomplished with one-hand thereby allowing a person or user more flexibility while using the tensioning assembly 5 to steady or secure cargo with the other hand.

The tensioning assembly 5 of one embodiment may further include a first guide roller 130 rotatably positioned between the first and second sidewalls 15, 20 of the housing 10 for promoting line 60 contact with the rotatable gripping wheel assembly 35. In this regard, guide roller 130 preferably includes a generally bulbous or protruding surface 135 to urge the line 60 exiting the tensioning assembly 5 against the gripping wheel assembly 35. Persons of ordinary skill in the art will understand that such a guide roller 130 may likewise be positioned between the first and second sidewall 15, 20 of the housing 15 to promote line 60 contact with the gripping wheel assembly 35 as the line 60 enters the tensioning assembly 5.

Figure 5:
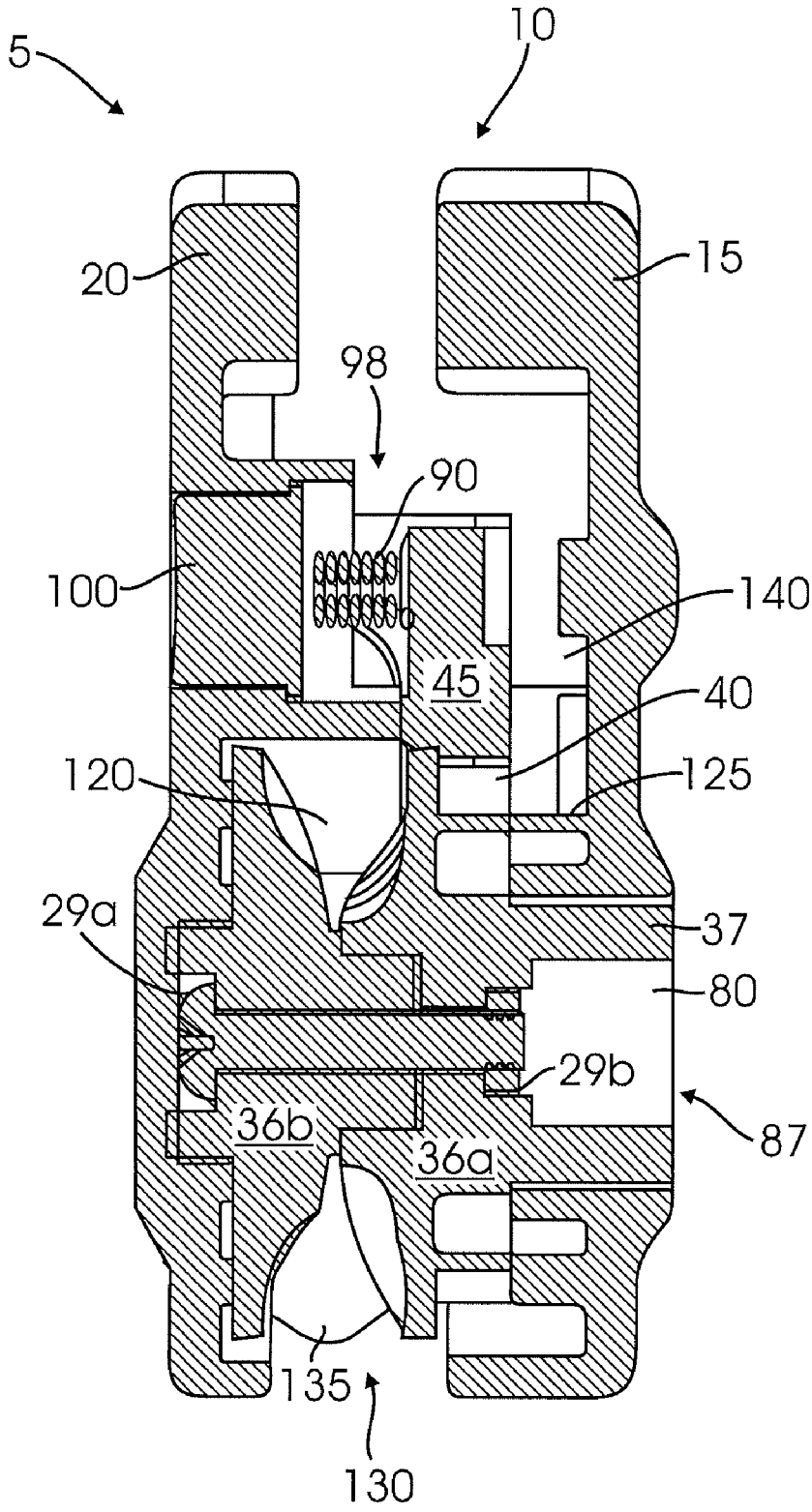
FIG. 5 is a cross-sectional end view of the tensioning assembly of FIG. 1 in accordance with one embodiment.

FIG. 5 shows a cross-sectional side view of the tensioning assembly of FIG. 1 in accordance with one embodiment. FIG. 5 shows the rotatable gripping wheel assembly 35 including the first portion 36*a* and second portion 36*b* positioned together within the housing 15, the plurality of outward extending teeth 40 concentrically positioned on the cylindrical boss 37, and the cavity 80 formed in the cylindrical boss 37 of the first portion 36*a* for receiving a tensioning device.

FIG. 5 further shows the pawl 45 pivotally-mounted within the housing 15 and the pivot pin 90 extending from the pawl 45 and being received into the cap 100 positioned within the cylindrical opening 105 in the second sidewall 20 of the housing 15. A gap or space 140 shown between the pawl 45 and the first sidewall 15 of the housing 15 facilitates lateral movement of the tension release assembly 98 to laterally disengage the pawl 45 from the outwardly extending teeth 40 of the gripping wheel assembly 35 when urged by a lateral force applied to the cap 100.

Although the method(s)/step(s) are illustrated and described herein as occurring in a certain order, the specific order, or any combination or interpretation of the order, is not required. Obvious modifications will make themselves apparent to those of ordinary skill in the art, all of which will not depart from the essence of disclosed subject matter, and all such changes and modifications are intended to be encompassed within the appended claims.

What is claimed is:

1. A ratchet mechanism, comprising:

a wheel rotatable about an axis of rotation; and a pawl positioned and configured to engage the wheel to permit rotation of the wheel in a single direction, and to laterally disengage from the wheel when lateral pressure is applied to the pawl, wherein the pawl is laterally biased to laterally engage the wheel by a first tension spring, and rotatably biased to rotatably engage the wheel by a second tension spring.

2. The ratchet mechanism of claim 1, wherein the first tension spring is operably connected to one side of the pawl, and the second tension spring is operably connected to an opposite side of the pawl.

3. The ratchet mechanism of claim 2, wherein one end of the first tension spring is received into a corresponding cavity formed in the one side of the pawl, and the second tension spring is positioned about a pivot pin extending from the opposite side of the pawl.

4. The ratchet mechanism of claim 3, wherein the ratchet mechanism is retained between a first sidewall and a second sidewall, the other end of the first tension spring is operably connected to the first sidewall, and the pivot pin is operably connected to the second sidewall.

5. The ratchet mechanism of claim 4, wherein the pivot pin is received into a cap having a cavity configured to receive a portion of the pivot pin, the cap being positioned and biased by the first tension spring to permit lateral movement of the cap within a cylindrical opening formed in the second sidewall.

6. The ratchet mechanism of claim 5, wherein the pawl disengages from the wheel when lateral pressure in opposition to the bias provided by the first tension spring is applied to the cap.

7. A tensioning assembly, comprising:

a housing having a first sidewall and a second sidewall; and a ratchet mechanism disposed between the first sidewall and the second sidewall, the ratchet mechanism includes a tension release assembly biased in a first direction for lateral engagement with the ratchet mechanism and lateral disengagement of the ratchet mechanism when pressure is applied to the tension release assembly in a second direction that is opposite to the first direction.

8. The tensioning assembly of claim 7, wherein the ratchet mechanism includes a rotatable wheel assembly having a cavity formed therein, the cavity accessible from an opening in the first sidewall and configured to receive a tensioning device for rotating the ratchet mechanism.

9. The tensioning assembly of claim 8, wherein the cavity is configured to receive a drive ratchet.

10. The tensioning assembly of claim 7, further including rotatable guide wheel positioned between the first sidewall and the second sidewall, the guide wheel shaped to urge one of a line exiting the housing or a line entering the housing against the ratchet mechanism.

11. The tensioning assembly of claim 10, wherein the guide wheel includes a protruding surface to urge the line exiting or the line entering the housing against the ratchet mechanism.

12. A tensioning assembly, comprising:

a housing having a first sidewall and a second sidewall; and a ratchet mechanism disposed between the first sidewall and the second sidewall, the ratchet mechanism includes a tension release assembly biased in a first direction for lateral engagement with the ratchet mechanism and lateral disengagement of the ratchet mechanism when pressure is applied to the tension release assembly in a second direction that is opposite to the first direction, wherein the tension release assembly includes a pawl rotatably biased to engage a rotatable wheel of the ratchet mechanism to permit rotation of the wheel in a single direction, and is laterally biased in the first direction to engage the wheel and disengage from the wheel when pressure is applied in the second direction.

13. The tensioning assembly of claim 12, wherein the pawl is laterally biased to laterally engage the wheel by a first tension spring, and rotatably biased to rotatably engage the wheel by a second tension spring.

14. The tensioning assembly of claim 13, wherein the first tension spring is operably connected to one side of the pawl, and the second tension spring is operably connected to an opposite side of the pawl.

15. The tensioning assembly of claim 14, wherein one end of the first tension spring is received into a corresponding cavity formed in the one side of the pawl, and the second tension spring is positioned about a pivot pin extending from the opposite side of the pawl.

16. The tensioning assembly of claim 15, wherein the other end of the first tension spring is operably connected to the first sidewall, and the pivot pin is operably connected to the second sidewall.

17. The tensioning assembly of claim 16, wherein the pivot pin is received into a cap having a cavity configured to receive a portion of the pivot pin, the cap being positioned and biased by the first tension spring to permit lateral movement of the cap within a cylindrical opening formed in the second sidewall, the pawl disengaging from the wheel when lateral pressure in opposition to the bias provided by the first tension spring is applied to the cap.

* * * * *